US008915758B2

(12) United States Patent
Shishikura et al.

(10) Patent No.: US 8,915,758 B2
(45) Date of Patent: Dec. 23, 2014

(54) ELECTRICAL CONNECTOR

(71) Applicant: Tyco Electronics Japan G.K., Kanagawa-ken (JP)

(72) Inventors: Seiji Shishikura, Chiba (JP); Hiroyuki Iketani, Kanagawa (JP)

(73) Assignee: Tyco Electronics Japan G.K., Kanagawa-ken (JP)

( * ) Notice: Subject to any disclaimer, the term of this patent is extended or adjusted under 35 U.S.C. 154(b) by 72 days.

(21) Appl. No.: 13/720,111

(22) Filed: Dec. 19, 2012

(65) Prior Publication Data

US 2013/0183842 A1 Jul. 18, 2013

(30) Foreign Application Priority Data

Dec. 28, 2011 (JP) ..... 2011-288050

(51) Int. Cl.

| | |
|---|---|
| ***H01R 13/502*** | (2006.01) |
| ***H01R 13/518*** | (2006.01) |
| ***H01R 13/629*** | (2006.01) |
| ***H01R 13/447*** | (2006.01) |
| ***H01R 13/506*** | (2006.01) |
| ***H01R 13/514*** | (2006.01) |

(52) U.S. Cl.

CPC ..... *H01R 13/447* (2013.01); *H01R 13/518* (2013.01); *H01R 13/629* (2013.01); *H01R 13/506* (2013.01); *H01R 13/514* (2013.01)

USPC ..... 439/701

(58) Field of Classification Search

CPC ... H01R 13/514; H01R 13/506; H01R 13/518

See application file for complete search history.

(56) References Cited

U.S. PATENT DOCUMENTS

| | | | | | |
|---|---|---|---|---|---|
| 3,273,107 | A | * | 9/1966 | Chandler | 439/717 |
| 3,605,068 | A | * | 9/1971 | Rayburn | 439/291 |
| 3,848,951 | A | * | 11/1974 | Michaels et al. | 439/357 |
| 4,425,018 | A | * | 1/1984 | Stenz | 439/716 |
| 4,682,839 | A | * | 7/1987 | Bryce | 439/598 |
| 4,984,992 | A | * | 1/1991 | Beamenderfer et al. | 439/108 |
| 5,122,077 | A | * | 6/1992 | Maejima et al. | 439/398 |
| 5,154,630 | A | * | 10/1992 | Kamono et al. | 439/352 |
| 5,201,674 | A | * | 4/1993 | Okura | 439/595 |
| 5,286,225 | A | * | 2/1994 | Tsuji | 439/752 |
| 5,288,250 | A | * | 2/1994 | Sumida | 439/701 |

(Continued)

FOREIGN PATENT DOCUMENTS

| | | |
|---|---|---|
| JP | 2007-95360 | 4/2007 |
| JP | 2011-96397 | 5/2011 |

OTHER PUBLICATIONS

European Search Report, Application No. 12198282.1, dated Feb. 21, 2014, 6 pages.

*Primary Examiner* — Ross Gushi

(74) *Attorney, Agent, or Firm* — Barley Snyder

(57) ABSTRACT

The invention relates to an electrical connector having a plurality of contact housings and a lock housing. The plurality of contact housings are vertically positioned upon each other. Each contact housing having a first end, a second end, and a step portion disposed between the first end and the second end. The lock housing includes a cover plate extending across an upper side of the plurality of contact housings and a lock arm extending from the cover plate and engageable with at least one of the plurality of contact housings. The lock arm includes an end portion engageable with the step portion.

10 Claims, 6 Drawing Sheets

(56) References Cited

U.S. PATENT DOCUMENTS 5,288,251 A * 2/1994 Sumida ..... 439/701
5,312,276 A * 5/1994 Hnatuck et al. ..... 439/681
5,320,555 A * 6/1994 Okabe ..... 439/354
5,346,412 A * 9/1994 Fedder et al. ..... 439/681
5,368,505 A * 11/1994 Hoolhorst et al. ..... 439/701
5,387,130 A * 2/1995 Fedder et al. ..... 439/607.47
5,421,746 A * 6/1995 David ..... 439/701
5,775,954 A * 7/1998 Kerckhof et al. ..... 439/701
5,890,933 A * 4/1999 Okabe ..... 439/701
5,895,296 A * 4/1999 Okabe ..... 439/701
5,904,598 A * 5/1999 Yamanashi ..... 439/701
5,921,807 A * 7/1999 Okabe ..... 439/467
5,934,944 A * 8/1999 Aoyama et al. ..... 439/701
5,947,774 A * 9/1999 Abe ..... 439/701
5,957,719 A * 9/1999 Okabe ..... 439/404
5,957,732 A * 9/1999 Ito et al. ..... 439/752
5,975,961 A * 11/1999 Atsumi et al. ..... 439/701
5,997,362 A * 12/1999 Hatagishi et al. ..... 439/701
6,000,971 A * 12/1999 Hatagishi et al. ..... 439/701
6,007,386 A * 12/1999 Okabe ..... 439/701
6,036,543 A 3/2000 Panis et al.
6,045,409 A * 4/2000 Abe ..... 439/701
6,059,612 A * 5/2000 Aoyama et al. ..... 439/701
6,068,522 A * 5/2000 Aoyama et al. ..... 439/701
6,093,061 A * 7/2000 Varsik et al. ..... 439/701
6,106,326 A * 8/2000 Schramme ..... 439/460
6,120,332 A * 9/2000 Bertens et al. ..... 439/701
6,129,593 A * 10/2000 Aoyama et al. ..... 439/701
6,149,447 A * 11/2000 Maeda et al. ..... 439/157
6,176,745 B1 * 1/2001 Furutani ..... 439/701
6,231,398 B1 * 5/2001 Furutani et al. ..... 439/701
6,273,762 B1 * 8/2001 Regnier ..... 439/701
6,332,811 B1 * 12/2001 Sato ..... 439/701
6,332,812 B1 * 12/2001 Kazuhara ..... 439/701
6,336,831 B1 * 1/2002 Abe ..... 439/701
6,340,316 B2 * 1/2002 Nagai ..... 439/701
6,343,959 B2 * 2/2002 Sato ..... 439/701
6,343,960 B1 * 2/2002 Sato ..... 439/701
6,352,452 B1 * 3/2002 Jimenez et al. ..... 439/680
6,354,887 B2 * 3/2002 Maeda ..... 439/701
6,361,374 B1 * 3/2002 Lloyd et al. ..... 439/701
6,371,788 B1 * 4/2002 Bowling et al. ..... 439/358
6,386,925 B1 * 5/2002 Sato et al. ..... 439/701
6,406,335 B2 * 6/2002 Sato et al. ..... 439/701
6,409,551 B1 * 6/2002 Nagai ..... 439/701
6,447,344 B2 * 9/2002 Sato et al. ..... 439/701
6,488,546 B2 * 12/2002 Sakurai et al. ..... 439/701
6,524,135 B1 * 2/2003 Feldman et al. ..... 439/607.46
6,537,080 B2 * 3/2003 Sato ..... 439/43
6,551,119 B1 * 4/2003 Sakamoto et al. ..... 439/287
6,592,410 B2 * 7/2003 Yoshida et al. ..... 439/701
6,619,997 B1 * 9/2003 Wilson et al. ..... 439/701
6,634,101 B2 * 10/2003 Sato ..... 29/876
6,645,003 B2 * 11/2003 Yoshida et al. ..... 439/507
6,702,623 B2 * 3/2004 Fukuda et al. ..... 439/701
6,739,910 B1 * 5/2004 Wu ..... 439/607.06
6,743,050 B1 * 6/2004 Wu ..... 439/607.06
6,773,305 B2 * 8/2004 Wu ..... 439/607.07
6,814,620 B1 * 11/2004 Wu ..... 439/607.08
6,830,489 B2 * 12/2004 Aoyama ..... 439/701
6,840,820 B2 * 1/2005 Oda ..... 439/724
6,848,932 B2 * 2/2005 Bowling et al. ..... 439/358
6,857,912 B2 * 2/2005 Wu ..... 439/701
6,918,774 B2 * 7/2005 Wu ..... 439/65
6,921,289 B2 * 7/2005 Takahashi et al. ..... 439/507
7,186,151 B2 * 3/2007 Komiyama ..... 439/701
7,297,031 B2 * 11/2007 Leddy ..... 439/701
7,297,032 B2 * 11/2007 Kobayashi et al. ..... 439/701
7,347,744 B2 * 3/2008 Tabata et al. ..... 439/752
7,354,318 B2 * 4/2008 Murakami et al. ..... 439/701
7,422,490 B2 * 9/2008 Droesbeke et al. ..... 439/701
7,425,160 B2 * 9/2008 Lee ..... 439/701
7,485,012 B2 * 2/2009 Daugherty et al. ..... 439/701
7,553,198 B1 * 6/2009 Leddy ..... 439/701
7,572,154 B2 * 8/2009 Ichio et al. ..... 439/701
7,682,183 B2 * 3/2010 Kanazawa ..... 439/357
7,695,315 B2 * 4/2010 Hitchcock et al. ..... 439/541.5
7,762,846 B1 * 7/2010 Whiteman et al. ..... 439/607.23
7,841,913 B2 * 11/2010 Hitchcock et al. ..... 439/752
8,187,041 B2 * 5/2012 Ito ..... 439/701
8,435,074 B1 * 5/2013 Grant et al. ..... 439/607.23
8,529,300 B2 * 9/2013 Ritter et al. ..... 439/701
2001/0003077 A1 * 6/2001 Van Woensel ..... 439/701
2001/0010986 A1 * 8/2001 Maeda ..... 439/701
2001/0053631 A1 * 12/2001 Nagai ..... 439/625
2002/0002016 A1 * 1/2002 Sato et al. ..... 439/701
2002/0025731 A1 * 2/2002 Sato ..... 439/701
2002/0052152 A1 * 5/2002 Sakurai et al. ..... 439/701
2002/0076990 A1 * 6/2002 Fujita ..... 439/701
2002/0115355 A1 * 8/2002 Yoshida et al. ..... 439/701
2002/0123272 A1 * 9/2002 Yoshida et al. ..... 439/701
2003/0100228 A1 * 5/2003 Bungo et al. ..... 439/701
2003/0176103 A1 * 9/2003 Sakamoto et al. ..... 439/541
2003/0194914 A1 * 10/2003 Duck et al. ..... 439/701
2004/0033731 A1 * 2/2004 Oda ..... 439/709
2004/0077228 A1 * 4/2004 Wu ..... 439/701
2004/0203280 A1 * 10/2004 Chang ..... 439/541.5
2004/0253880 A1 * 12/2004 Correll et al. ..... 439/752
2004/0259420 A1 * 12/2004 Wu ..... 439/608
2004/0266273 A1 * 12/2004 Wu ..... 439/701
2005/0118883 A1 * 6/2005 Kim ..... 439/701
2006/0228932 A1 * 10/2006 Komiyama ..... 439/467
2007/0072492 A1 * 3/2007 Kobayashi et al. ..... 439/701
2007/0128951 A1 * 6/2007 Leddy ..... 439/701
2008/0119084 A1 * 5/2008 Hitchcock et al. ..... 439/541.5
2008/0124975 A1 5/2008 Droesbeke et al.
2008/0200063 A1 * 8/2008 Lee ..... 439/541.5
2008/0200075 A1 * 8/2008 Murakami et al. ..... 439/701
2009/0004922 A1 * 1/2009 Daugherty et al. ..... 439/660
2010/0136842 A1 6/2010 Sakamoto et al.
2010/0151746 A1 * 6/2010 Hitchcock et al. ..... 439/701
2011/0014820 A1 * 1/2011 Ito ..... 439/701
2012/0238139 A1 * 9/2012 Pan et al. ..... 439/620.22
2013/0183842 A1 * 7/2013 Shishikura et al. ..... 439/147
2013/0237068 A1 * 9/2013 Katsuse ..... 439/76.2
2014/0017951 A1 * 1/2014 Tsai ..... 439/638

* cited by examiner

Prior Art

Prior Art

ELECTRICAL CONNECTOR

CROSS-REFERENCE TO RELATED APPLICATIONS

This application claims the benefit of the filing dates under 35 U.S.C. §119(a)-(d) of JP Patent Application No. 2011-288050, filed on Dec. 28, 2011.

FIELD OF THE INVENTION

The invention relates to an electrical connector and, more particularly, to an electrical connector having stacked contact housings.

BACKGROUND

In recent years, the number of terminals for an electrical connector (hereinafter, an electrical connector is sometimes referred to simply as "connector") for use in the field of automobiles and the like has increased.

Accordingly, there is a known electrical connector having multi-stacked and combined contact housings, wherein each housing accommodates a plurality of terminals aligned side by side in one direction (for example, as disclosed in Japanese Patent Laid-Open No. 2007-95360 and Japanese Patent Laid-Open No. 2011-96397). Each of the stacked contact housings includes a protrusion and an engaging piece to be engaged with this protrusion, formed on its side face. Thus, the vertically aligned contact housings are coupled together when the protrusion of one of the contact housings engages with an engaging piece on the other contact housing.

With reference to FIG. 5, a known connector 3 is shown having a lock housing 2 that couples with a plurality of stacked contact housings 1. For each contact housing 1, a recess 5 is disposes along a lower surface 1*c* side thereof, while a protrusion 6 is disposes on an upper surface 1*d* side, which is opposite to the lower surface side 1*c*. Accordingly, the contact housings 1 can vertically align and stack upon each other when a catch formed on a tip of the protrusion 6 couples with an engaging member formed on the recess 5.

Moreover, when the contact housings 1 are stacked, the protrusion 6 of the lower one of the contact housings 1 enters into the recess 5 of the upper one of the contact housings 1. As a result, movement of the stacked contact housings 1 relative to each other can be prevented. A first face 1*a* and a second face 1*b* (on the opposite side thereof) of each of the contact housing 1 can maintain alignment with respect to each other, as stacked.

However, in the above-mentioned structure, a length of the protrusion 6 is made smaller than a length of the recess 5 so as to easily engage the recess 5 and the protrusion 6 with each other. For this reason, a clearance C is formed between the recess 5 and the protrusion 6 along the respective lengths. As a result, a certain amount of positional displacement may occur within the clearance C between the contact housings 1 when vertically aligned with each other.

In the case when, as shown in FIG. 5, the connector 3 includes stacked contact housings 1 (for example, five stages in FIG. 5), if all the paired contact housings 1 all vertically aligned with each other are displaced in the same direction, the lowermost contact housing 1 is considerably displaced relative to the lock housing 2, as shown in FIG. 6. As a result, a contact held on the contact housing 1 with the great amount of displacement and a contact held on the counter connector may not ensure an effective mating length.

SUMMARY

In view of this technical problem, an electrical connector according to the invention is provided. The electrical connector includes a plurality of contact housings and a lock housing. The plurality of contact housings are vertically positioned upon each other. Each contact housing having a first end, a second end, and a step portion disposed between the first end and the second end. The lock housing includes a cover plate extending across an upper side of the plurality of contact housings and a lock arm extending from the cover plate and engageable with at least one of the plurality of contact housings. The lock arm includes an end portion engageable with the step portion.

BRIEF DESCRIPTION OF THE DRAWINGS

The invention will be explained in greater detail in the following with reference to embodiments, referring to the appended drawings, in which.

DETAILED DESCRIPTION OF THE EMBODIMENTS

Figure 1:
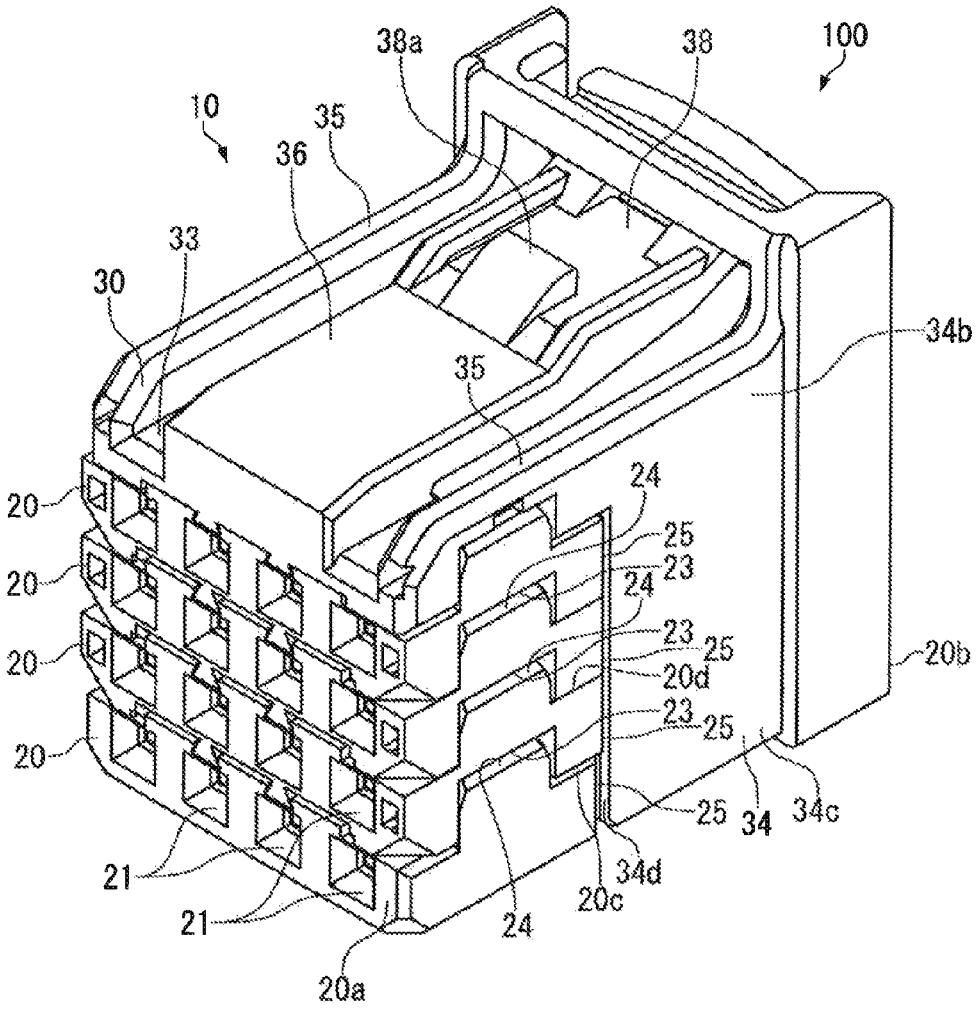
FIG. 1 is a front, top perspective view that shows an electrical connector according to the invention.
Figure 2:
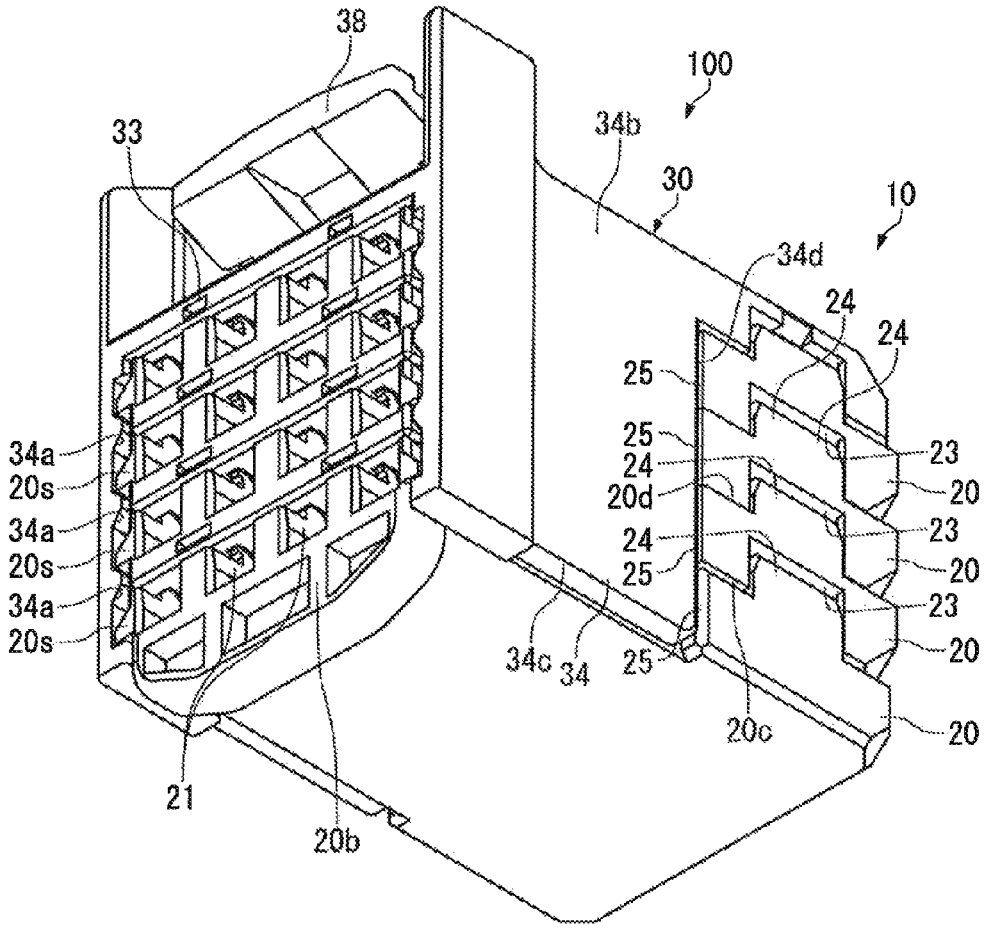
FIG. 2 is a rear, bottom perspective view of the electrical connector of FIG. 1.

The following description will discuss the present invention in detail based upon embodiments illustrated in the attached drawings.

As shown in FIGS. 1 to 4, an electrical connector 100, such as a male connector, to be mated with a mating connector (not shown), such as a female connector, is shown. In the embodiment shown, the electrical connector 100 includes a housing 10 that accommodates a plurality of female contacts (not shown).

The housing 10 of the electrical connector 100 is made of an insulating material such as a resin.

The housing 10 includes a plurality of stacked contact housings 20 (four stages in the shown embodiment) and a lock housing 30 that engages with all of the contact housings 20. Each contact housing 20 is stacked vertically upon one another.

Each of the contact housings 20 includes a plurality of contact receiving passageways 21 formed side by side along one another. Each contact receiving passageway 21 penetrates from through the contact housing 20, from a first face 20*a* to a second face 20*b* which is opposite the first face 20*a*. A female contact (not shown) made of a conductive material may be inserted into the contact receiving passageway 21. Furthermore, in each contact housing 20, a wire (not shown) connected to the female contact (not shown) is drawn from the second face 20*b* side.

A recess 23 is disposed on a lower face 20*c* side of each contact housing 20, while a protrusion 24 disposed on the upper face 20*d* side of each contact housing 20.

Figure 3:
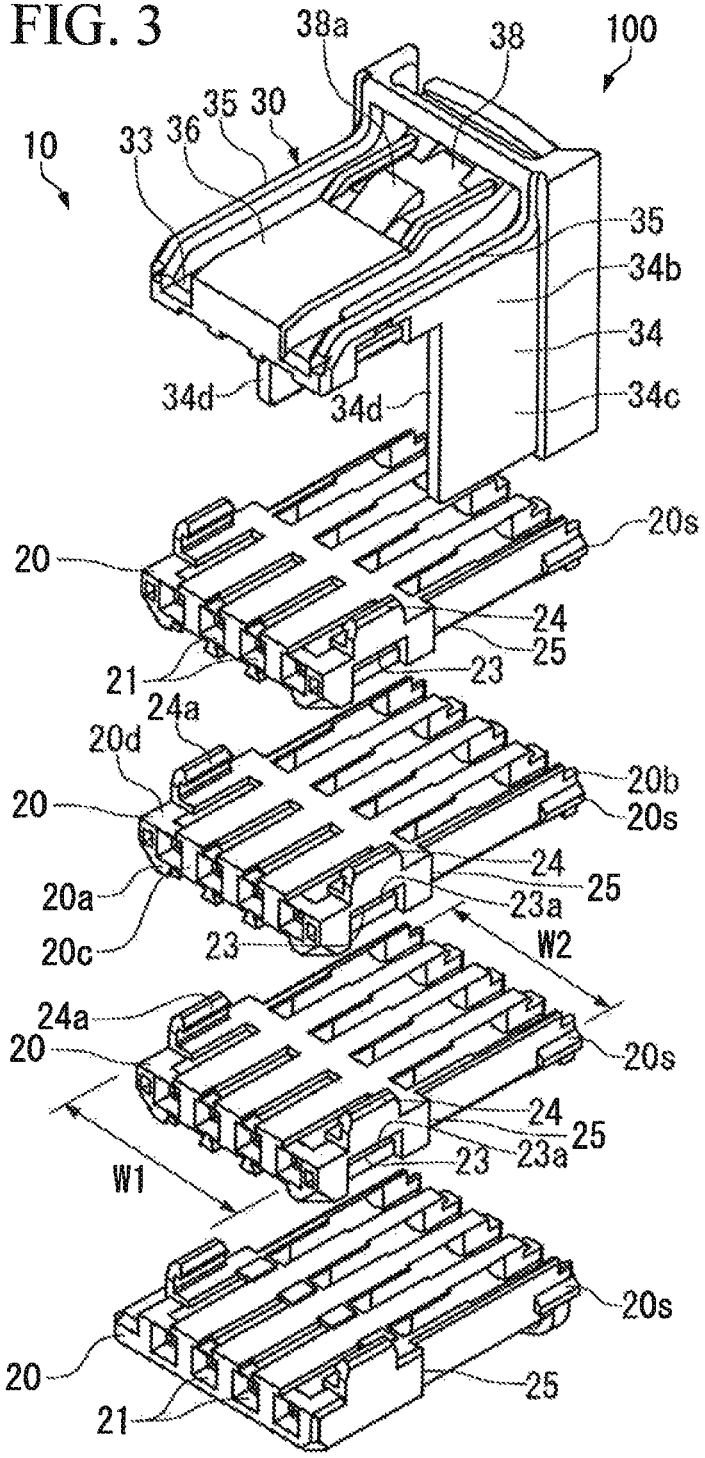
FIG. 3 is an exploded perspective view of the electrical connector of FIG. 1.

A catch 24*a* is disposed on a tip of the protrusion 24, and is meant to engage with an engaging member 23*a* disposed along the recess 23 (see FIG. 3). As a result, the contact housings 20 may vertically aligned with each other when stacked and coupled together.

Furthermore, upon vertically stacking a plurality of contact housings 20, the protrusion 24 of the contact housing 20 (located below) is inserted into the recess 23 of the other contact housings 20 (located above). As a result, movement of the stacked contact housings 20 is prevented, such that displacement of an individual contact housing 20 from an alignment of the second faces 20*b* is prevented.

In this case, each contact housing 20 is formed such a housing width W1 of the first face 20*a* side, including a portion having the recess 23 and the protrusion 24, is larger than a housing width W2 on the second face 20*b* side. Accordingly, a step portion 25 is disposed along a middle portion of opposite side faces of the contact housing 20, between first face 20*a* and the second face 20*b*.

The lock housing 30 includes a cover plate 33 that covers an upper side of the stacked plural contact housings 20 and lock arms 34 extending from the cover plate 33 and along the two opposite side faces of the stacked contact housings 20.

The cover plate 33 includes a pair of outer protruding bars 35 and an inner protruding bar 36 that extend upward from a major surface thereof, and extend from a front end to a rear end in the embodiment shown. The outer protruding bars 35 are formed on two opposite sides along a width of the cover plate 33, while the inner protruding bar 36 is disposed along a substantial center portion along the width direction, between the pair of outer protruding bars 35. The outer and inner protruding bars 35, 36 are inserted into guide grooves formed in the mating connector, so that the inserting direction of the electrical connector 100 relative to the mating connector is guided.

An elastic locking member 38 that substantially extends in parallel with the cover plate 33 is formed on the rear end portion of the inner protruding bar 36. A locking catch 38*a* is formed on the upper surface of this elastic locking member 38. This locking catch 38*a* is engaged with an engaging recess (not shown) formed on an inner circumferential surface of the female connector so that the housing 10 stays mated with the female connector housing during assembly.

Each lock arm 34 extends downward from opposite sides of the cover plate 33 such that the lock arms follow the two opposite side faces of the stacked contact housings 20. Each lock arm 34 includes engaging protrusions 34*a* on the side facing the stacked contact housings 20 (see FIG. 2). The engaging protrusions 34*a* engage with protrusions 20*s* formed on the rear end portions of each of the contact housings 20.

Each lock arm 34 includes a base portion 34*b* extending downward from the cover plate 33 and a tip 34*c* extending from the base portion. The tip 34*c* is elastically deformable in a direction orthogonal to the side faces of the stacked contact housings 20, that is, moving away from the side face around the base portion 34*b*.

Figure 4:
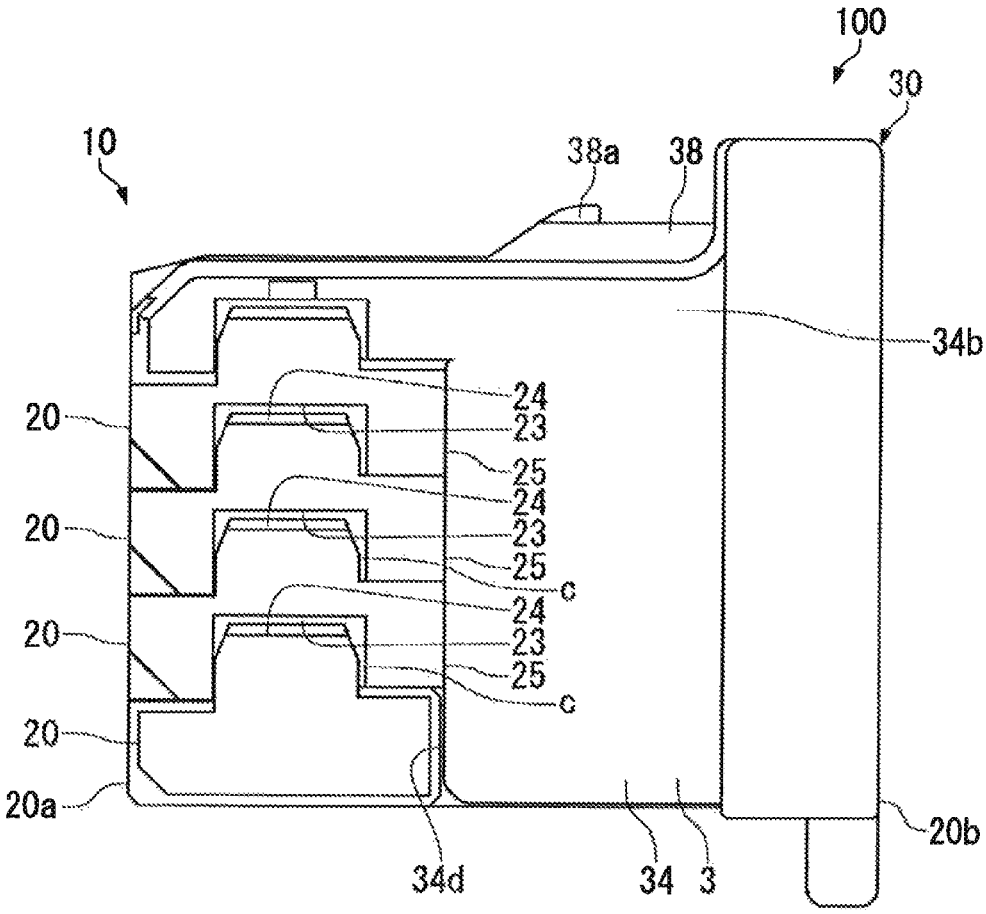
FIG. 4 is a side view of the electrical connector of FIG. 1.
Figure 5:
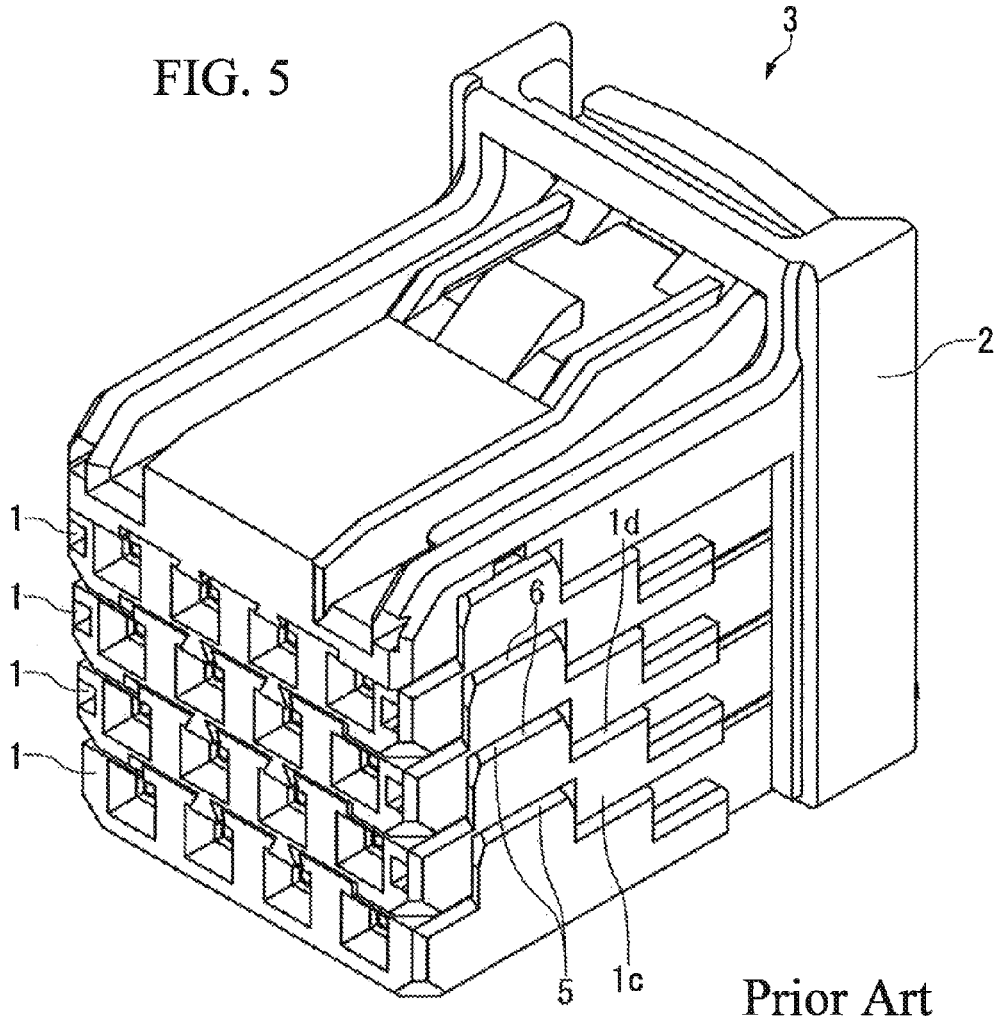
FIG. 5 is a perspective view of a known electrical connector.
Figure 6:
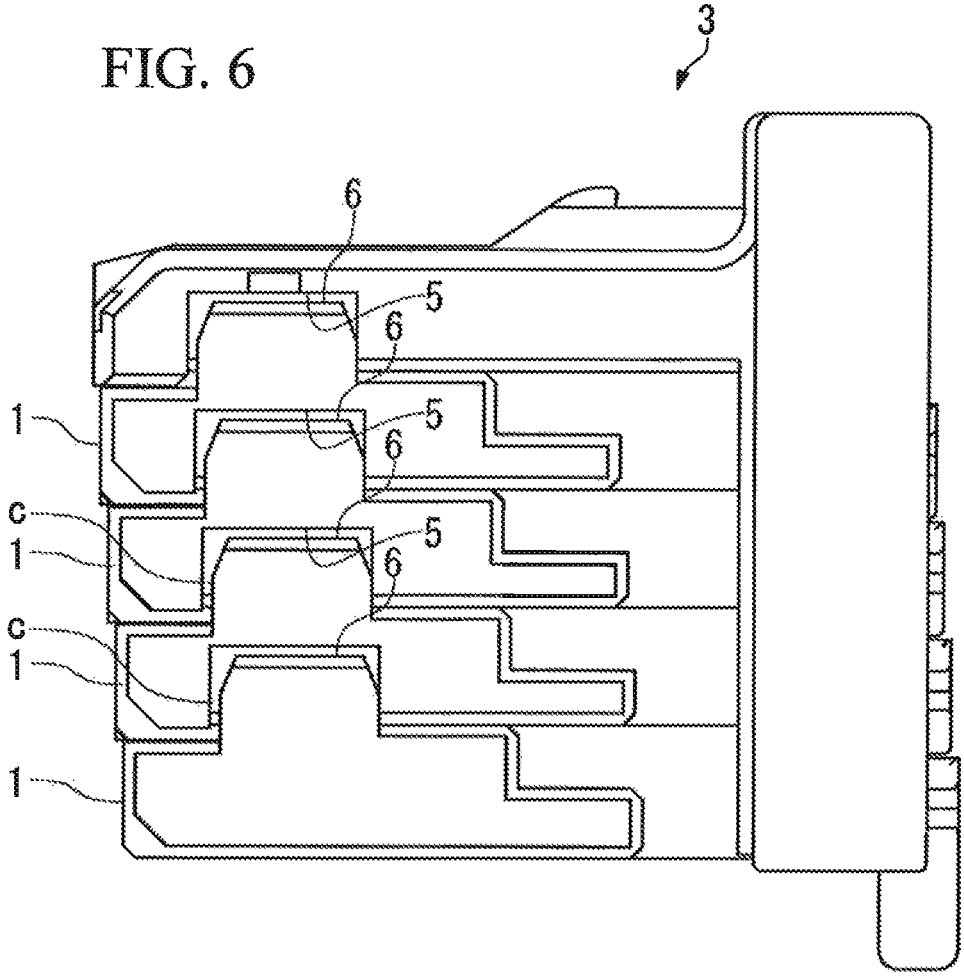
FIG. 6 is a side view of the known connector of FIG. 5.

Each lock arm 34 includes an end portion 34*d* having a linear shape that extends along the stacking direction of the contact housings 20 as shown in FIGS. 3 and 4.

Thus, each lock arms 34 extends along the two opposite side faces of the stacked contact housings 20, and allows each of the engaging protrusions 34*a* to engage with the protrusion 20*s* of each of the contact housings 20, along each respective stage thereof. As a result, the lock housing 30 integrally couples all of the stacked contact housings 20, and the end portion 34*d* of the lock arm 34 faces each of the step portions 25 of the stacked contact housings 20. In addition, the step portions 25 abut against the end portions 34*d* of the lock arms 34, respectively, and consequently the stacked contact housings 20 are restricted from linearly moving out of alignment with respect to the first and second faces 20*a*, 20*b*.

As described above, the lock housing 30 integrally couples each of the contact housings 20 to one another, with the end portion 34*d* of each lock arm 34 facing the step portion 25 of each contact housing 20. As a result, even when a clearance C is formed between the recess 23 and the protrusion 24 of two stacked contact housings 20, the contact housing 20 on each stage is restricted from linearly moving toward the second face 20*b* side because the step portion 25 abuts against the end portion 34*d* of each lock arm 34. With this arrangement, it is possible to prevent a large positional displacement from occurring between the contact housings 20 and consequently ensures a sufficient mating connection between the electrical connector 100 and the mating connector.

The structures of the electrical connector described above are merely exemplary and may be modified to any other structures without departing from the gist of the present invention.

For example, the lock arms 34 are disposed along two opposite sides of the cover plate 33, but could be installed only on either one of the sides.

Furthermore, the structure as described includes engaging protrusions 34*a* that engage each of the contact housings 20, stacked on top of one another. However, the invention is not limited to this structure. Rather, the lock housing 30 may be used that only engages with the lower most contact housing 20 of the stacked structure.

Furthermore, the structure as described includes four stages of stacked contact housings 20. However, one skilled in the art would appreciate that the structure could be prepared using two or more stacked contact housings 20.

Besides, the structure described in the above embodiment can be selected or can be changed as appropriate to another structure without departing from the gist of the present invention.

What is claimed is:

1. An electrical connector comprising:

a plurality of contact housings vertically positioned upon each other, each contact housing having a first end, a second end, a step portion disposed there between; and a lock housing comprising:

a cover plate extending across an upper side of the plurality of contact housings and having a pair of outer protruding bars disposed along a major surface thereof and an inner protruding bar extending upward from the major surface and positioned between the pair of outer protruding bars;

an elastic locking member extending parallel with the major surface and positioned on a rear end portion of the inner protruding bar; and a lock arm extending from the cover plate and engageable with at least one of the plurality of contact housings and having an end portion engageable with the step portion.

2. The electrical connector according to claim 1, wherein one of the plurality of contact housings includes a housing protrusion disposed on a first side along a rear end portion thereof.

3. The electrical connector according to claim 2, wherein the lock arm further includes an engaging protrusion disposed along an inner surface thereof and engageable with the housing protrusion.

4. The electrical connector according to claim 1, wherein the elastic locking member includes a locking catch disposed on an upper surface thereof.

5. The electrical connector according to claim 1, wherein the lock arm includes a base portion extending downward from the cover plate and a tip extending from the base portion.

6. The electrical connector according to claim 5, wherein the tip is elastically deformable in a direction orthogonal to a side of the plurality of contact housings.

7. The electrical connector according to claim 1, wherein each contact housing includes a recess disposed on a lower surface thereof.

8. The electrical connector according to claim 7, wherein each contact housing further includes a protrusion disposed on an upper surface thereof and corresponding with the recess of an adjacent contact housing.

9. The electrical connector according to claim 1, wherein a width of the first end is greater than a width of the second end.

10. The electrical connector according to claim 9, wherein the width of the lock housing is greater than the width of the second end.

* * * * *